US005701941A

United States Patent [19]

Pasternak

[11] Patent Number: 5,701,941

[45] Date of Patent: Dec. 30, 1997

[54] ADJUSTABLE HANGING SUPPORT MECHANISM FOR FOLDING PANEL ASSEMBLY ENCLOSURE

[75] Inventor: Gerald S. Pasternak, Naples, Fla.

[73] Assignee: Dynaflair Corporation, Tampa, Fla.

[21] Appl. No.: 657,663

[22] Filed: May 30, 1996

[51] Int. Cl.[6] ..... E05D 15/26

[52] U.S. Cl. ..... 160/199; 160/196.1; 16/87 R

[58] Field of Search ..... 160/199, 206, 160/196.1, 40; 52/64; 49/417, 452, 409; 16/87 R

[56] References Cited

U.S. PATENT DOCUMENTS

| | | | |
|---|---|---|---|
| 3,359,594 | 12/1967 | Pastoor | 160/199 X |
| 5,085,262 | 2/1992 | Tutikawa | 160/199 |
| 5,301,735 | 4/1994 | Chen | 160/199 |
| 5,499,671 | 3/1996 | Owens | 160/199 |

*Primary Examiner*—Blair Johnson
*Attorney, Agent, or Firm*—Carter & Schnedler

[57] ABSTRACT

An adjustable hanging support mechanism for a folding panel assembly enclosure which comprises a plurality of folding panels and end posts secured thereto and which fold in an accordion fashion while being suspended by the support mechanism along a top end thereof. The hanging support mechanism has a support rod which is connected at a top end to a displaceable carriage which is engaged in a support rail. The support rod has a plurality of spaced fastener engaging apertures extending along a connecting section thereof. The apertures are configured to receive a fastener element in engagement therewith. At least some of the panels are provided with connecting cylinders to receive at least a connecting section of an associated one of the support rods in axial rotation therein. Fastener elements are associated with the connecting cylinders to permit interconnection with a selected one of the fastener engaging apertures of an associated support post to provide vertical height adjustment of the enclosure.

15 Claims, 3 Drawing Sheets

ADJUSTABLE HANGING SUPPORT MECHANISM FOR FOLDING PANEL ASSEMBLY ENCLOSURE

TECHNICAL FIELD

The present invention relates to an adjustable hanging support mechanism for a folding panel assembly enclosure and wherein the mechanism is of simple construction and provides hanging support at a plurality of support points along a top edge of the assembly while permitting vertical adjustment thereof.

BACKGROUND ART

Hanging doors are suspended by rods or brackets each having a glide mechanism which slides or rolls in a track affixed to a ceiling or an overhead support. For doors which hang from brackets attached to rollers or guides, slots are usually provided in the bracket which attach to the door by screws and the slots allow for vertical height adjustment. For doors which hang from rods attached to rollers or guides, slots are usually provided in the bracket to which the rod is secured and adjustment is provided by the bracket. The rod can also be threaded and nuts are used to set the hanging position. All of the aforementioned means of adjustment allow for very small incremental settings and work satisfactorily for doors hung by two or a very limited number of points. The purpose of these adjustments is usually for leveling.

The adjustable hanging support mechanisms of the prior art have, however, been unsatisfactory for changing door hanging heights over large incremental distances or height adjustments of from 0.5 to 1 inch or more. Folding doors which have many hanging points are very difficult to adjust in height as each hanger or support mechanism must be gauged to balance the hanging load from hanger to hanger while preserving smooth sliding and folding operation when the panel assembly is opened or closed. Another problem with such hanging support mechanisms is that because there are many hanging points often some will not provide proper adjustment and support, and consequently there will not be even wear of these mechanisms throughout the door span. A still further disadvantage of prior art hangers, is that many of these have complex mechanisms which lead to more mechanical failures, they are also more difficult to assemble and disassemble when there is a need to adjust the height of the door. They also result in frequent break-downs which necessitate more repair and maintenance.

SUMMARY OF INVENTION

It is therefore a feature of the present invention to provide an adjustable hanging support mechanism for folding panel assembly enclosures which substantially overcomes the above disadvantages of the prior art.

Another feature of the present invention is to provide an adjustable hanging support mechanism for folding panel assembly enclosures which is simple in construction, which is installed quickly, requires little maintenance and permits easy and quick adjustment even when the folding panel assembly is suspended by its hangers.

According to the above features, from a broad aspect, the present invention provides an enclosure comprising a folding panel assembly having a plurality of interconnected folding panels and end posts, as well as a plurality of hanging support mechanisms for slidingly supporting the assembly suspended from a rail at spaced intervals along a top end of the panel assembly and permitting the panels to fold in an accordion fashion. The hanging support mechanism has a support element connected at a top end to displaceable track engagement means. The support element has a plurality of spaced fastener engaging apertures extending along a connecting section thereof. The apertures are configured to receive a fastener element in frictional engagement therewith. Channel means is provided in at least some of the panels to receive at least the connecting section of an associated one of the support rods in axial rotation therein. Fastener arresting means is associated with the channel means of the panels for receiving a fastener means therein to permit interlocking connection with a selected one of the fastener engaging apertures of an associated support element to provide vertical height adjustment of the enclosure.

BRIEF DESCRIPTION OF DRAWINGS

A preferred embodiment of the present invention will now be described with reference to the accompanying drawings in which.

DESCRIPTION OF PREFERRED EMBODIMENTS

Figure 1:
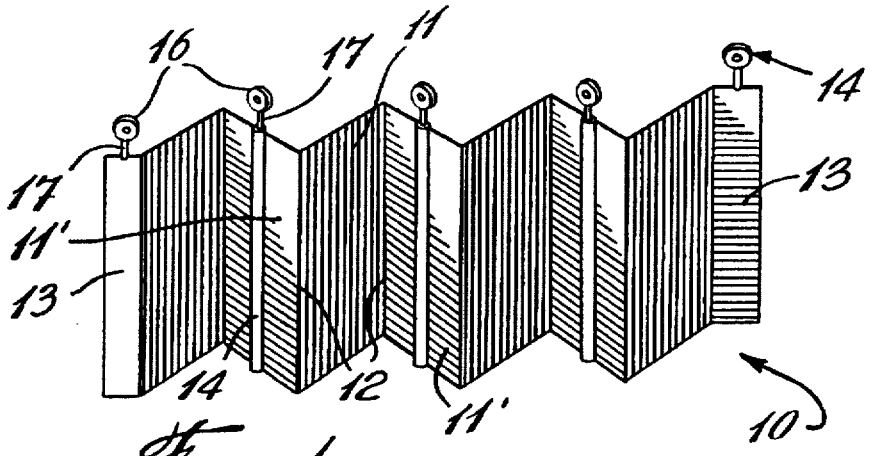
FIG. 1 is a perspective view of a simplified schematic diagram showing a typical enclosure formed of folding panels and end posts.
Figure 5:
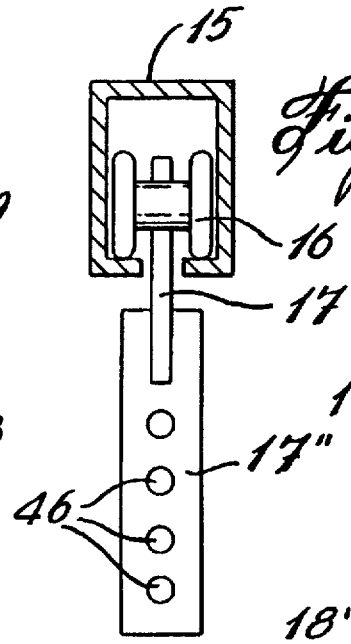
FIG. 5 is a simplified plan view showing the construction of an end post support mechanism.

Referring now to the drawings, and more particularly to FIG. 1, there is shown generally at 10 an enclosure which is fabricated by an assembly of folding panels 11 and 11' which are interconnected along vertical edges 12 thereof by hinge means (not shown) which is well known in the art. End posts 13 are provided at opposed ends of the panel assembly. The assembly is supported across an opening by a plurality of hanging support mechanisms 14 which are connected to certain ones of the panels, herein panels 11' which are provided with connecting cylinders 14 longitudinally and centrally thereof whereby all the panels may be supported in an overhead track 15, as shown in FIG. 5, by displaceable track engagement means, herein shown in the form of a wheel carriage 16 connected to the top end of the support rod 17 of the support mechanism 14.

Figure 6:
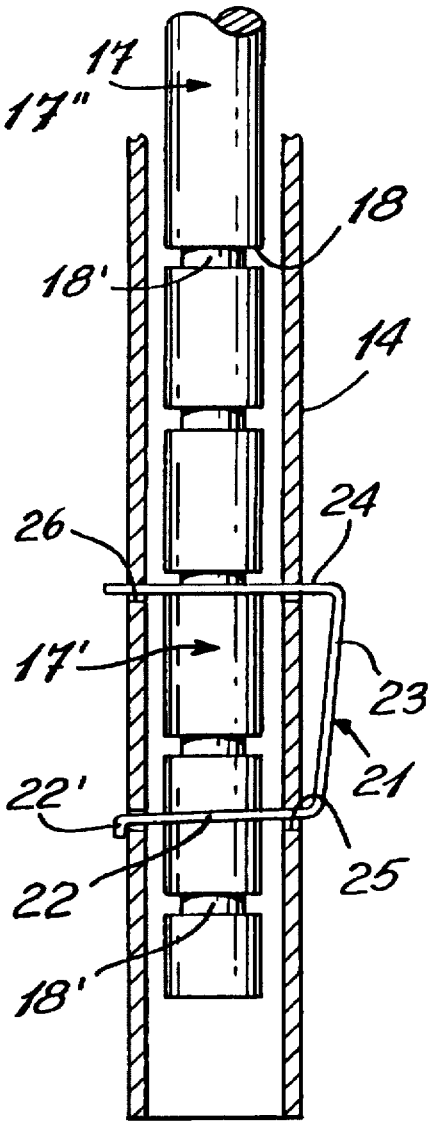
FIG. 6 is a partly sectioned view showing a support rod interconnected within a connecting cylinder of a panel by means of a U-shaped flexible clip.

As shown in FIG. 6 the support rod 17 is provided with a plurality of spaced fastener engaging circumferential slots 18 extending along a lower connecting section 17' thereof. These fastener engaging circumferential slot 18 are equidistantly spaced apart along the connecting section 17'. The lower connecting sections 17' of the support rod are disposed within the open top end of the connecting cylinder 14 of certain ones of the panels, herein panels 11' as illustrated in FIG. 2.

Figure 2:
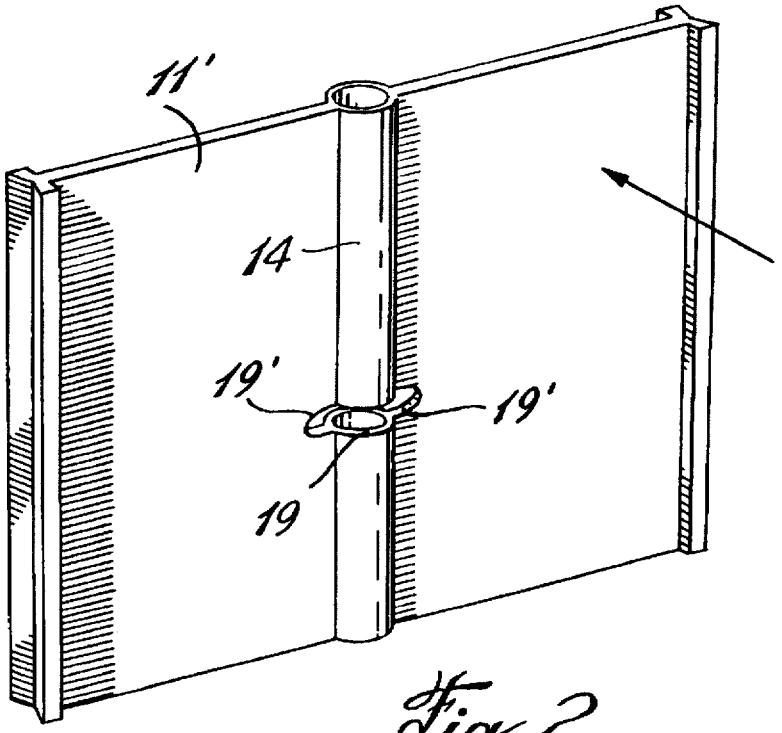
FIG. 2 is a perspective view of one of the panels showing the connecting cylinder provided with a slot to receive a fastener element to secure the panel to a support post of a hanging support mechanism.
Figure 3:
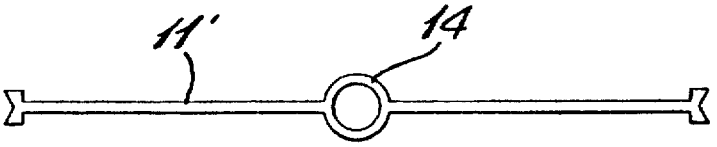
FIG. 3 is a top view of FIG. 2.
Figure 9A:
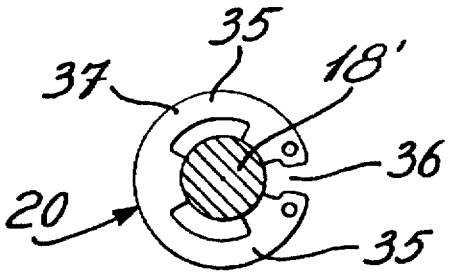
FIG. 9A is a plan view showing a flat flexible E-clip for securing the support rod to the cylinder.

As shown in FIG. 2, each panel 11' has a connecting cylinder 14 disposed centrally therein in at least a top portion of the panel and extends along a vertical axis of the panel. This cylinder 14 is of circular cross-section and the lower connecting section of the support rod is also of circular cross-section and dimensioned for close sliding fit within an associated one of the cylinders 14 whereby it can be axially rotated therein as the panels fold in an accordion fashion. A connecting slot 19 is also provided transversely across the cylinder 14 and extending in adjacent portions 19' of the panel 11'. The connecting slot 19 is dimensioned to receive a fastener arresting means such as the flexible E-clip 20 as shown in FIG. 9A, and wherein the E-clip 20 engages within a selected one of the circumferential slots 18 and abuts the adjacent portions 19' of the panel to immovably secure the support rod 17 within the connecting cylinder 14 at a desired location and also permits for the vertical height adjustment of the folding panel enclosure 10. The connecting element, such as the flexible E-clip 20 is also detachably engageable within a selected one of the slots 18 for ease of connection and disconnection of the support rod 17 with the panels to provide ease of adjustment.

Referring again to FIGS. 6 to 8, there is shown another embodiment of the connecting clip 21, and as hereinshown it is constituted by a U-shaped flexible clip provided with an attachment arm 22 provided with a circular through bore 23' therein to permit the passage of the connecting section 17' of the support rod therethrough. An intermediate wall section 23 also interconnects a connecting arm 24 in spaced relationship with respect to the attachment arm 22 and in opposed relationship. The attachment arm 22 extends through an attachment slot 25 provided across the connecting cylinder 14 similarly shaped to the slot 19 as shown in FIG. 2. A further slot 26 is also disposed across the connecting cylinder 14 to receive the connecting arm 24.

Figure 7:
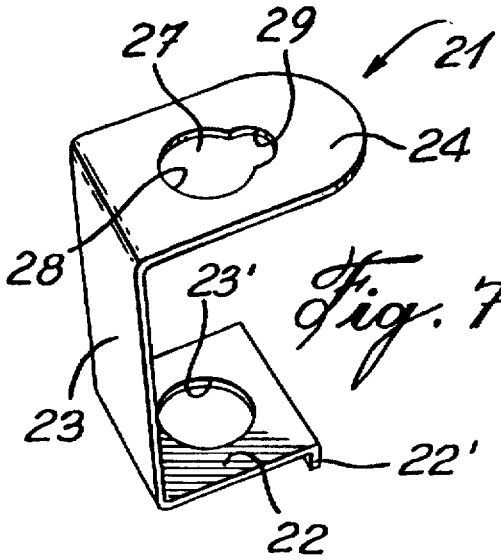
FIG. 7 is a perspective view of the clip.
Figure 8:
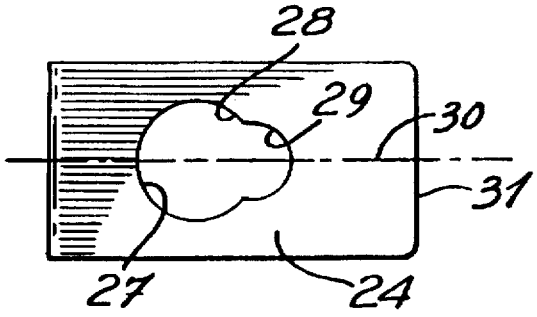
FIG. 8 is a top view of the attachment arm of the clip.

As shown in FIGS. 7 and 8, the connecting arm 24 has a rod engaging bore 27 having a circular circumferential edge 28 to permit the passage of the support rod 17 therethrough. A rod engaging cavity 29 is disposed along the longitudinal axis 30 of the connecting arm 24 and which extends transverse to the end edge 31 and which is aligned with the slot 26. This rod engaging cavity 29 is also dimensioned to receive, in close fit, the intermediate rod sections 18' of reduced circular cross-section of the rod 17, defined within the circumferential slot 18 whereby to removably engage the connecting cylinder 14 to the lower connecting section 17' of the support post 17, as shown in FIG. 6. A lip 22' may be formed at the end of the attachment arm 22 to prevent the arm from slipping out of the slot 25.

The intermediate wall section 23 of the connecting clip 21 is herein shown as extending angularly from the connecting cylinder 14 and spaced therefrom whereby to constitute a finger-engaging means to detach the attachment arm from the selected one of the circumferential slots 18. Because of the shape of the clip, it creates a spring action to bias the engaging cavity 29 against the rod 17 to engage with a selected one of the slots 18'. As can be seen by pushing the intermediate wall section 23 in the direction of the connecting cylinder 14 the cavity 29 of the connecting clip 21 disconnects from the support rod 17. It is now possible to displace the rod up and down in the cylinder 14 to a desired position at which the pressure on the wall section 23 is released to engage in a circumferential slot 18' close by.

Figure 9B:
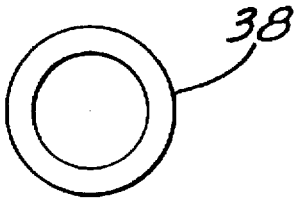
FIG. 9B is a plan view of a washer associated with the E-shaped clip of FIG. 9A.

As previously described, the connecting clip 21 may have a different form and as shown in FIG. 9A it may be constituted by a flexible E-clip or washer 20 which is provided with opposed flexible arms 35 to cause the mouth opening 36 of the clip to open whereby to receive the intermediate rod section 18' of the rod 17 within the circumferential slots 18. The flat circumferential wall 37 of the E-clip 20 may be dimensioned to extend partly within the adjacent portions 19' of the slot 19, formed in the panels 11' as shown in FIG. 2, whereby to secure the connecting section of the support rod 17 to the connecting cylinder 14. Alternatively, a force-spreading washer 38, as shown in FIG. 9B, may be positioned over the E-clip to evenly spread the force over the arms 35 of the E-clip 20.

Figure 10:
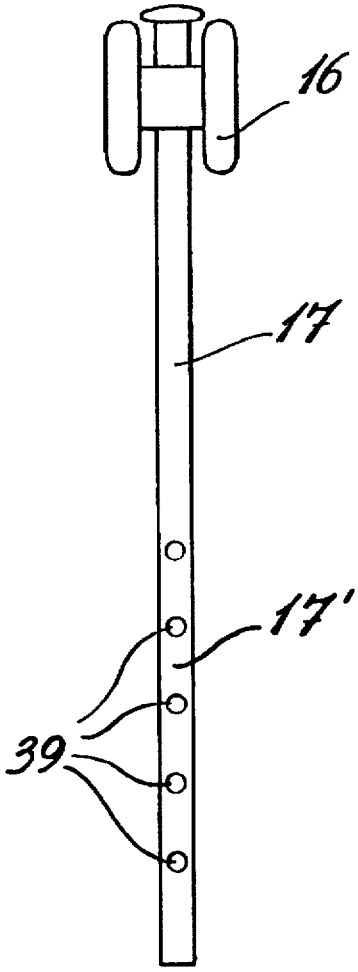
FIG. 10 is a plan view showing a modification of the fastener engaging apertures disposed along the connecting section of the support rod.
Figure 11:
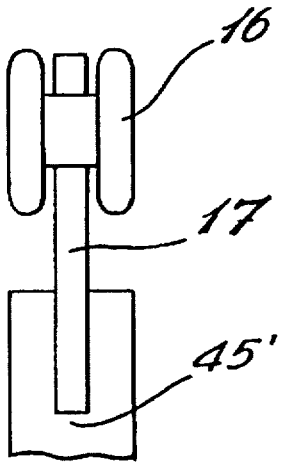
FIG. 11 is a perspective view of a disc-shaped collar to secure the support rod within an associated connecting cylinder.
Figure 11:
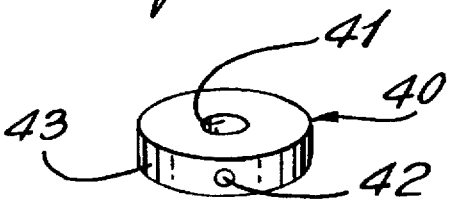

As shown in FIG. 10 the lower connecting section 17' of the support rod 17 is provided with fastener engaging apertures which are herein constituted by a plurality of spaced apart detents 39 formed along the connecting section of the rod and disposed in a straight row. There could of course be two or three of these detent rows about the support rod 17 to permit ease of assembly and particularly if the top end of the support rod is pivotally connected to the wheel carriage 16. In order to connect the rod 17 of FIG. 10 to the connecting cylinder 14 of the panels 11', there is provided as shown in FIG. 11, a connecting element in the form of a disc-shaped collar 40 having a central through bore 41 for the passage of the connecting section 17' of the support rod 17. The collar 40 is disposed within a slot, similar to the slot 19 as shown in FIG. 2, and a locking screw 42 which extends through a side wall 43 of the disc extends through the side wall of the bore 41 and extends therein for engagement with a selected one of the detents 39 or else can extend within a selected one of the circumferential slots 18 of the rod as shown in FIG. 6 to permit the interconnection.

Figure 4:
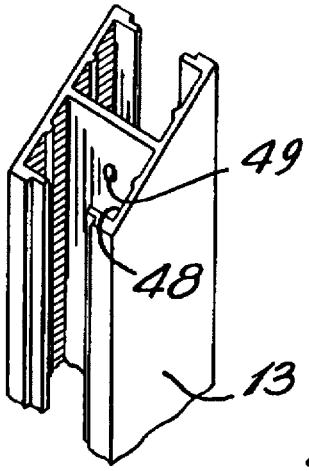
FIG. 4 is a perspective view, partly fragmented, showing the construction of an end post.

Referring now to FIGS. 4 and 5 there is shown the construction of the connecting end post support mechanism. As hereinshown, the connection section 17" of the support rod 17 is provided in the form of a hanger plate 45 having one or more connecting apertures 46 therein. These apertures provide for attachment within the top end of the connecting post 13 and more particularly with a side wall 47 of the channel 48 of the extruded post 13. As hereinshown the side wall 47 is provided with a single aperture 49 to align with a selected one of the apertures 46 to interconnect the hanger plate 45 within the channel at a desired height.

Figure 12:
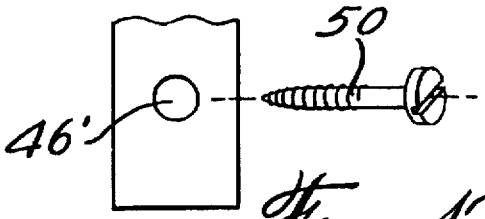
FIG. 12 is an exploded view illustrating the construction of an embodiment of the end post support mechanism.

FIG. 12 shows an exploded view of a post support mechanism but modified slightly wherein the hanger plate 45' is provided with a single aperture 46' and wherein the side wall 47' of the post 13 is provided with a plurality of apertures 49' to provide for the variable adjustment. It is, of course, understood that the length of the hanger plate 45' is sufficient to provide attachment to all of these apertures 49'. A screw 50 provides for the connection.

It is within the ambit of the present invention to cover any obvious modifications of the preferred embodiment described herein, provided such modifications fall within the scope of the appended claims.

I claim:

1. In an enclosure comprising a folding panel assembly having a plurality of interconnected folding panels and end posts and a plurality of hanging support mechanisms for slidingly supporting said assembly suspended from a rail at spaced intervals along a top end of said panel assembly and permitting said panels to fold in an accordion fashion, the improvement comprising said hanging support mechanism having a support element connected at a top end to displaceable track engagement means, said support element having a plurality of spaced fastener engaging apertures extending along a connecting section thereof, said apertures being configured to receive a fastener element in engagement therewith, channel means in at least some of said panels to receive at least said connecting section of an associated one of said support element in axial rotation therein, fastener arresting means associated with said channel means of said panels for receiving a fastener means therein to permit interlocking connection with a selected one of said fastener engaging apertures of an associated support element to provide vertical height adjustment of said enclosure.

2. A hanging support mechanism as claimed in claim 1 wherein said hanging support mechanisms also comprise end post support mechanisms connected at a top end to displaceable track engagement means, said end post support mechanisms having a support rod with a connecting section connectable to an associated one of said end posts through a selected one of connecting apertures, said connecting section being positionable in a channel top end section of said end posts, and fastener means to interconnect said connecting section to said associated end post, said connecting apertures being equidistantly spaced apertures.

3. A hanging support mechanism as claimed in claim 1 wherein said channel means in at least some of said panels is comprised by a connecting cylinder disposed substantially centrally in at least a top end position of said panels and extending longitudinally along a vertical axis thereof, said connecting cylinder being of circular cross-section, said connecting section of said support element being dimensioned for close fit in said cylinder and capable of axial rotation therein, said support element being a support rod.

4. A hanging support mechanism as claimed in claim 3 wherein said fastener arresting means is a detachable connecting element disposable in slot means provided across said connecting cylinder, said connecting element being detachably engageable with a selected one of said plurality of equidistantly spaced fastener engaging apertures.

5. A hanging support mechanism as claimed in claim 4 wherein said connecting element is a connecting clip having an attachment arm to secure said clip to said connecting cylinder and a detachably engageable arm extending into said slot means for detachable connection with said selected one of said plurality of equidistantly spaced fastener engaging apertures.

6. A hanging support mechanism as claimed in claim 5 wherein said fastener engaging apertures are circumferential slots provided along said connecting section of said support rod.

7. A hanging support mechanism as claimed in claim 6 wherein said connecting clip is a flexible U-shaped clip, said attachment arm having a circular through bore for the passage of said connecting section of said support rod therethrough, said attachment arm extending through an attachment slot provided across said connecting cylinder, said clip having an angled intermediate wall section interconnecting said connecting arm to said detachably engageable arm in opposed spaced relationship and for applying a biasing pressure of an edge of said bore against said rod, said connecting arm extending into a further slot spaced from said attachment slot, said connecting arm having a rod engaging bore defined by a bore section having a circular circumferential edge to permit the passage of said support rod therethrough, and a rod engaging cavity disposed in an edge of said bore for engagement in said selected one of said circumferential slots.

8. A hanging support mechanism as claimed in claim 7 wherein said intermediate wall section is disposed spaced from said connecting cylinder and constitutes a finger engaging means to detach said attachment arm from said selected one of said circumferential slots.

9. A hanging support mechanism as claimed in claim 6 wherein said connecting clip is a flat flexible E-clip having a flat circumferential wall with a side opening, said clip being engaged with said selected one of said circumferential slots through said slot means, said flat circumferential wall extending in part between opposed panel surfaces of said slot means to secure said connecting section of said support rod in said connecting cylinder.

10. A hanging support mechanism as claimed in claim 9 wherein there is further provided a backing washer dimensioned for close fit in said slot means and disposed above said E-shape clip to secure said connecting section of said rod in said connecting cylinder.

11. A hanging support mechanism as claimed in claim 4 wherein said connecting element is a disc-shaped collar having a circular central through bore for the passage of said connecting section of said support rod in said connecting cylinder, said collar being disposed in said slot means, and a locking screw disposed in a side wall of said collar and extending out of a side wall of said bore for engagement in a selected one of said fastener engaging apertures of said connecting section of said support rod extending in said connecting cylinder.

12. A hanging support mechanism as claimed in claim 11 wherein said fastener engaging apertures are circumferential slots provided along said connecting section of said support rod.

13. A hanging support mechanism as claimed in claim 11 wherein said fastener engaging apertures are constituted by a plurality of spaced-apart detents formed along said connecting section of said rod and disposed in a straight row, there being at least one of said rows of detents about said connecting section of said support rod.

14. A hanging support mechanism as claimed in claim 2 wherein said connecting section of said support rod is a hanger plate having one or more of said connecting apertures therein for attachment with one or more connecting apertures provided in a side wall of said channel of an associated one of said top end section of said end posts, said fastener means being a screw fastener disposed through aligned ones of said apertures in said hanger plate and side wall of said channel.

15. A hanging support mechanism as claimed in claim 1 wherein said displaceable track engagement means is a wheel carriage secured to a top end of said support rod and displaceably retained within a ceiling track.

* * * * *